United States Patent [19]

Allmon et al.

[11] 4,082,250

[45] Apr. 4, 1978

[54] LIFTING DEVICE

[76] Inventors: Leonard G. Allmon, 212 Pelham Rd., No. 11, Knoxville, Tenn. 37814; Michael C. Allman, Rte. No. 26, Kern Rd., Knoxville, Tenn. 37918

[21] Appl. No.: 828,987

[22] Filed: Aug. 30, 1977

[51] Int. Cl.[2] ..... B66F 7/26

[52] U.S. Cl. ..... 254/47; 254/45

[58] Field of Search ..... 254/45, 47, 131, 139, 254/139.1, 146

[56] References Cited

U.S. PATENT DOCUMENTS

| | | | |
|---|---|---|---|
| 1,879,313 | 9/1932 | King | 254/131 |
| 2,506,705 | 5/1950 | Coffing | 254/146 |
| 2,648,521 | 8/1953 | Sales | 254/47 |
| 3,304,058 | 2/1967 | Cheadle | 254/47 |
| 3,964,729 | 6/1976 | Harlow | 254/131 |

*Primary Examiner*—Robert C. Watson

[57] ABSTRACT

A device is described whereby one person can easily lift heavy objects such as truck camper covers, boats, mowers and the like, and whereby such objects can be retained effortlessly in the upraised position. The device comprises an adjustable load bearing means attached to a lever member, said lever member being pivotally mounted to the apex of an easily transportable supporting frame.

5 Claims, 6 Drawing Figures

LIFTING DEVICE

BACKGROUND OF THE INVENTION

The invention described herein relates to a lifting device that may be easily operated by one person and, more particularly, to a device for lifting and retaining in an upraised position such heavy objects as truck camper covers, boats, riding mowers and the like.

It is of particular use in lifting objects which must be raised for servicing, disassembly, or held in the lifted position for indeterminant periods of time. It is an improvement of known lifting devices such as that of A. J. Shamblin, U.S. Pat. No. 817,877; L. H. Jones, U.S. Pat. No. 1,105,278; O. C. Liles, U.S. Pat. No. 1,334,914 and T. J. Richards, U.S. Pat. No. 3,907,254.

A vehicle which has become more and more popular in the United States is the pick-up truck which can be converted to a camper. On the one hand the truck can be used for utilitarian purposes and then, with the application of a camper cover, can be converted into a recreational vehicle. Camper covers are, however, rather heavy and usually require at least two people to lift into position on the truck.

SUMMARY OF THE INVENTION

It is, therefore, a primary object of the invention to provide a device which one person can operate to remove or replace a camper cover onto the bed of a truck.

It is a further object of the invention to provide a device which can be used to hold a camper cover, boat, riding mower or the like in an upraised position for indeterminant periods of time.

It is still another object of the invention to provide a device for lifting heavy objects wherein said device has a locking mechanism attached thereto whereby said device can safely hold said heavy objects suspended in an upraised position for indeterminant periods of time.

The invention, accordingly, comprises an adjustable load bearing means attached to a lever member providing mechanical advantage thereto, said lever member being pivotally mounted to the apex of an easily transportable supporting frame, said frame being fixedly mounted onto a base member.

Further features and objects of the invention will be apparent from an examination of the accompanying specification and the drawings which illustrate the invention.

DESCRIPTION OF THE PREFERRED EMBODIMENT

Figure 1:
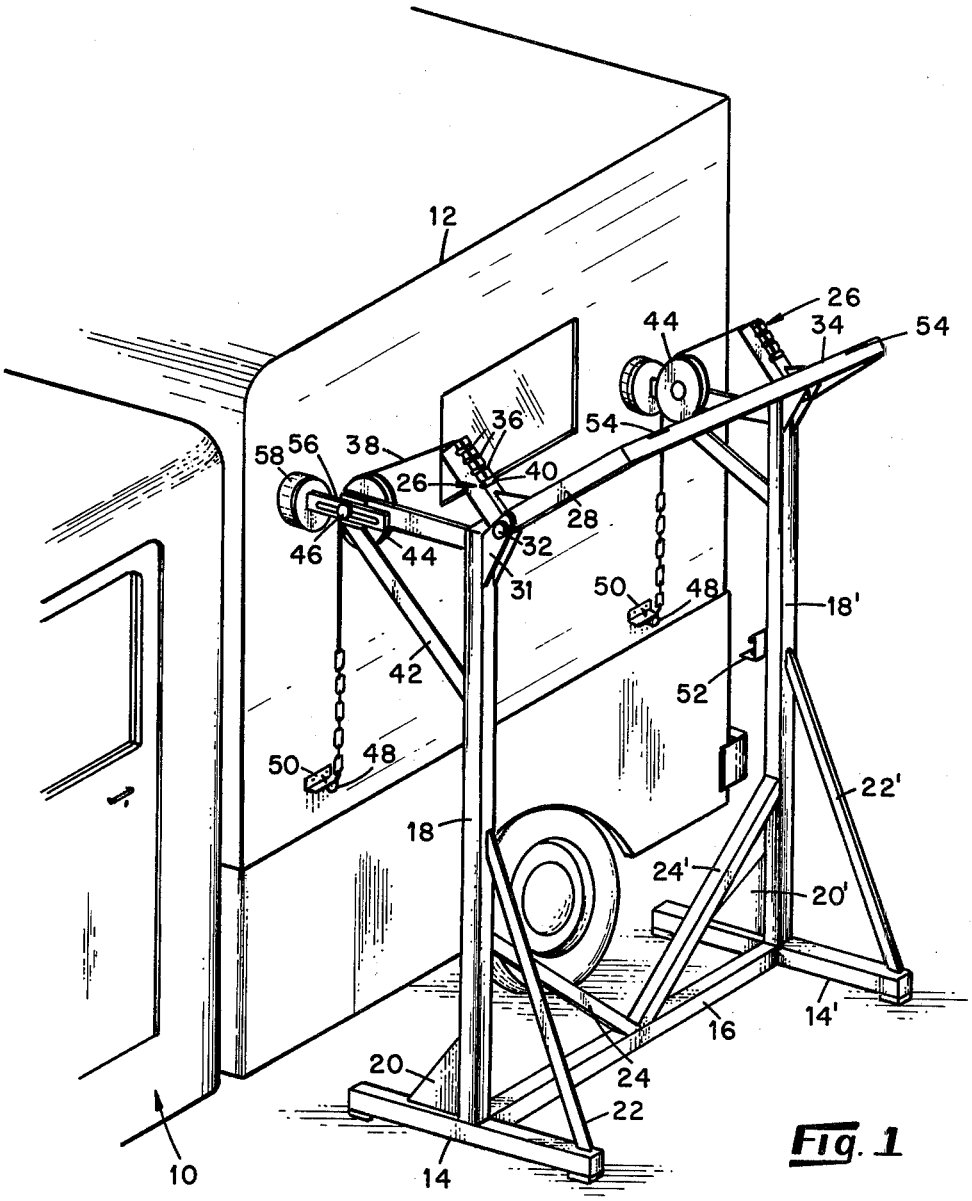
FIG. 1 is a perspective view of the device embodying the invention.
Figure 4:
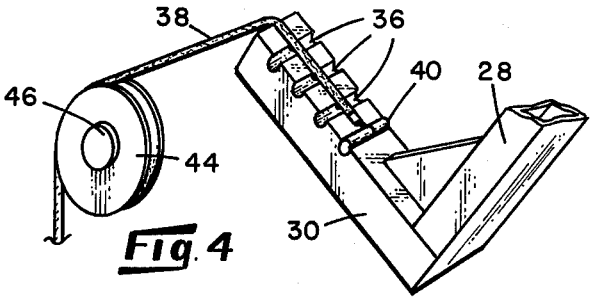
FIG. 4 is a perspective view showing arm details of the device embodying the invention.
Figure 6:
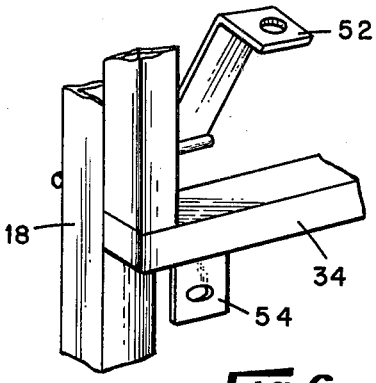
FIG. 6 is a perspective view showing latch details.

Referring to FIG. 1 and the several drawings in detail, reference numeral 10 denotes generally a vehicle having a camper cover 12 positioned thereupon.

The invention consists of a device for lifting or holding camper cover 12 in a raised position whereby said cover can be placed upon a vehicle or removed therefrom, and comprises a pair of base members 14, 14' joined by at least one cross beam member 16 and having left and right upstanding support members 18, 18' fixedly attached thereto. Upstanding support members 18, 18' are fixedly braced to base members 14, 14' by short bracing members 20, 20' and long bracing members 22, 22'. Cross beam member 16 is fixedly attached to upright support members 18, 18' and braced thereto by means of bracing members 24, 24'.

Base members, upstanding members and bracing members are preferably manufactured from tubular or angular metallic stock but may be made from other materials having comparable structural integrity. Said members, comprising the frame of the invention, may be fixedly joined one to another by permanent means such as by welding or brazing or may be joined by manufacturing said members to be removably attached one part into another, or the connections may be made by means of nuts, bolts, screws and the like.

It is to be understood that the subject invention has left and right upstanding support members on each end of cross beam 16, said upstanding support members having similar and cooperating components. For purposes of illustrating the invention reference will be made to a single side when the second side has duplicate and cooperating elements.

In the preferred embodiment L-shaped member 26 having a longer arm 28 and a shorter arm 30 is pivotally mounted to an offset projection 31 at the apex of upstanding support member 18 by means of pivot pin 32. A connecting bar 34 joins the distal ends of longer arms 28, one to another on the right and left side of the device whereby L-shaped members 26 are caused to operate synchronously and in unison.

Short arm 30 of L-shaped member 26 has attachment points 36 spaced incrementally along the length thereof whereby one end of cable 38 may be removeably attached thereto. Attachment points 36 may comprise a series of slotted indentations or holes in short arm 30 whereby an attachment means such as a pin 40 transversely attached to the end of cable or chain 38 can be removeably placed.

A pulley support arm 42 is fixedly mounted toward the apex of each of the upstanding support members 18, said pulley support arm 42 having a pulley 44 or similar friction reducing means rotatably mounted to said pulley support arm 42 by means of pin 46 passing through the center of pulley 44 and the outermost extremity of pulley support arm 42.

Cable or chain 38 has an attachment means such as hook 48 at the terminal end thereof for attachment to a lifting point such as stud 50 installed on the side of camper cover 12 whereby said cover is raised or lowered when the subject invention is utilized.

A rotatable latch 52 is mounted onto upstanding member 18 for securing connecting bar 34 and L-shaped members 26 subsequent to lifting the load. A locking plate 54 is positioned onto connecting bar 34 to correspond with latch 52 whereby a pin or lock passed therethrough will further secure the device in the raised position.

A brace 56 having a protective pad 58 on the exposed end thereof is positioned at the extremity of pulley support arm 42 whereby camper cover 12 is maintained in precise vertical alignment with the subject lifting device.

Figure 5:
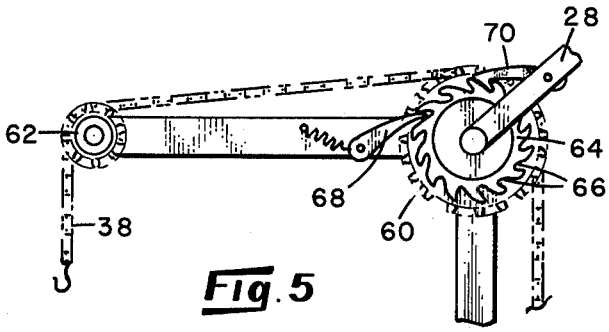
FIG. 5 is a second embodiment of the adjustable load bearing means of the invention.
Figure 3:
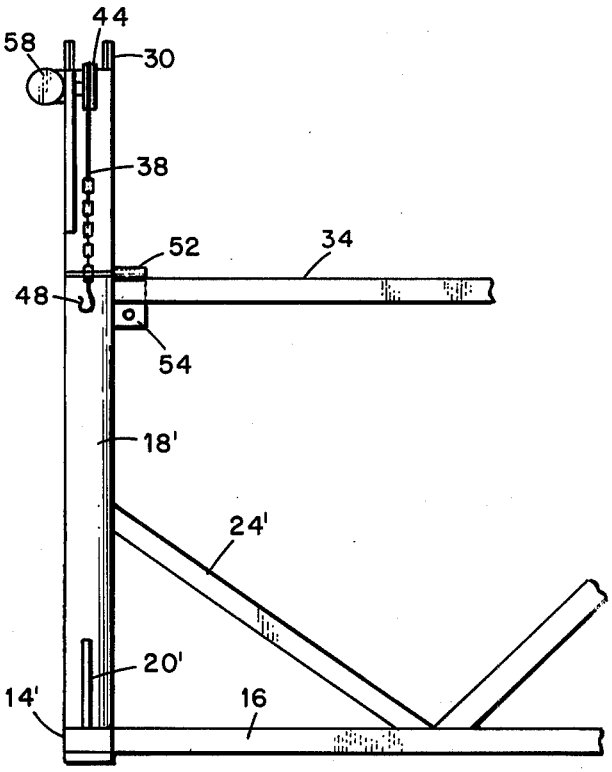
FIG. 3 is a side view showing the several components of the invention.

In a separate embodiment, shown in FIG. 5, longer arm 28 having sprocket wheel 60 pivotally attached to one end thereof is manipulated to raise or lower sprocket chain 38 over second sprocket wheel 62. The mechanism by which longer arm 28 operates to raise or lower the load comprises a ratchet wheel 64 having a series of toothed notches 66, said ratchet wheel being fixedly superimposed to sprocket wheel 60; a first spring-loaded pawl 68 being releasably engaged to said ratchet wheel 64 thereby preventing backward motion of said ratchet wheel 64; and a second hinged pawl 70 attached to longer arm 28 for engagement with said toothed notches 66 whereby sprocket wheel 60 is rotated and the load is raised.

It is understood that, in ordinary practice, a pair of lifting devices is needed, one on each side of the camper cover whereby said cover, or other object to be lifted, is only required to be raised a sufficient height for its weight to be removed from the original support.

It is also understood that it is possible for a single lifting device to be used where stud 50 is placed in the center of the roof of camper cover 12 whereby the weight of camper cover 12 is balanced about the lifting moment of the device.

In accordance with the foregoing description of the principal parts of the invention, the lifting device is operated by placing said device adjacent to the load to be lifted with attachment means 48 in vertical alignment with load lifting point 50 on said load.

Connecting bar 34 is rotated upward to an overhead position whereby cable or chain 38 having hook 48 at the terminal end thereof is lowered to the maximum extent possible. Hook 48 at the end of cable 38 is attached to the load to be lifted by means of protruding stud 50 or similar attaching means onto said load.

Cable 38 having pin 40 transversely attached to the end thereof is extended until all slack is removed whereupon pin 40 is engaged into the nearest slotted indentation or hole 36 available in short arm 30 of L-shaped member 26 whereby said cable is secured for lifting said load. It is understood that proper height adjustment of cable 38 may be obtained by several means available in the art such as hooks and eyelets, turnbuckles and the like.

Figure 2:
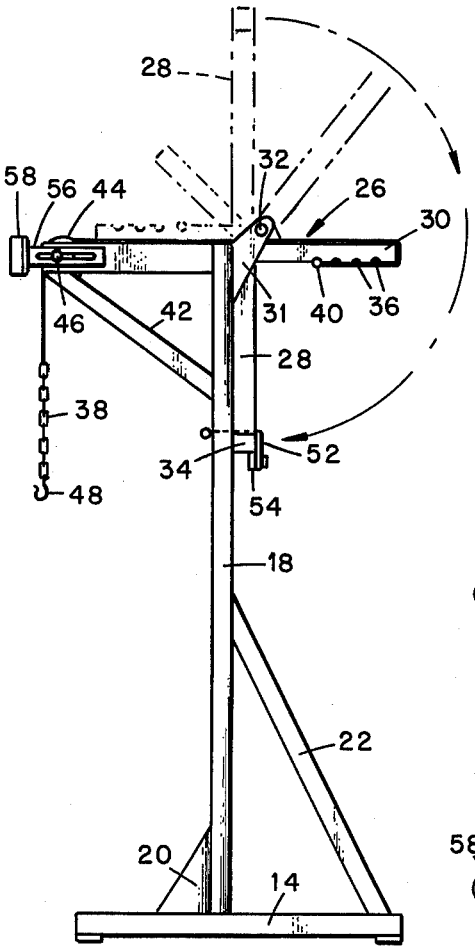
FIG. 2 is an end view of the device embodying the invention showing the manner in which the lifting arm is rotated to raise and lower the load.

Following fixing of the load to the lifting device the load is raised by grasping connecting bar 34 and rotating it outward and downward as shown in the phantom outline of FIG. 2. Offset projection 31 to which L-shaped member 26 is attached provides an additional degree of leverage whereby a minimum amount of downward pressure is required to easily and effortlessly raise even very heavy loads.

The load is lowered by reversing the aforedescribed procedure, i.e., rotate connecting bar 34 outward and upward to its fullest extent thereby causing L-shaped member 26 to rotate about pivot pin 32 until longer arm 28 is in the vertical position, as shown in phantom in FIG. 2, whereupon hooks 48 are disengaged from the load.

The subject invention provides a device whereby one person can easily and effortlessly lift heavy objects such as truck camper covers, boats, mowers and the like and whereby such objects can be secured in the upraised position. The device is of particular value in lifting a heavy object from a first raised position such as the bed of a pick-up or flat-bed truck to a second raised position wherein the vehicle can be driven away from the object, or conversely, the vehicle can be driven under the object for loading purposes.

A preferred embodiment of this invention has been set forth in the description and drawings. These descriptions are used in the generic sense only and not for purposes of limitation. Various changes may, therefore, be made therein without departing from the spirit and scope of the invention.

What is claimed is:

1. An apparatus for lifting and supporting heavy objects such as truck camper covers and the like comprising, a pair of base members, said base members joined by at least one cross beam member, at least one upstanding support member fixedly mounted to said base member, lever means pivotally mounted on said upstanding support member comprising an L-shaped member having a longer arm and a shorter arm, pivotally mounted at the junction of said longer arm and said shorter arm to an offset projection at the apex of said upstanding support member whereby rotational pressure exerted on said longer arm causes vertical displacement of said shorter arm, said shorter arm of said L-shaped member having spaced attachment means included thereon whereby said load bearing means is adjusted, and having an adjustable load-bearing means coupled to said lever means and locking means pivotally secured to said upstanding support member.

2. An apparatus for lifting and supporting heavy objects as set forth in claim 1 wherein said adjustable load-bearing means comprises a cable having a first and second end, said first end having a hook thereon for attachment to said heavy object, and wherein said second end is fixed to said attachment means.

3. An apparatus for lifting and supporting heavy objects as set forth in claim 2 wherein said attachment means includes at least two slotted indentations within said shorter arm wherein a pin attached to said second end of said cable is releasably fitted.

4. An apparatus for lifting and supporting heavy objects as set forth in claim 3 wherein said locking means comprises a latch rotatably mounted on said upstanding support member to overlay said lever means.

5. An apparatus for lifting and supporting bulky objects such as truck camper covers and the like comprising at least one base member, at least one upstanding support member fixedly mounted to said base member, lever means pivotally mounted to said upstanding support member, said lever means comprising an L-shaped member having a longer arm and a shorter arm and having a sprocket wheel pivotally mounted at the junction thereof whereby rotational pressure exerted on said L-shaped member causes said sprocket wheel to rotate, adjustable load-bearing means coupled to said lever means, said load-bearing means comprising a sprocket chain having a first and second end, said first end having attachment means for attaching said chain to said load and wherein said second end is fixed to said lever means and wherein said sprocket chain interlocks with said sprocket wheel whereby rotational pressure exerted on said lever means causes vertical displacement of said sprocket chain, and ratchet holding means coupled to said lever means, said ratchet holding means comprising a ratchet wheel having toothed notches fixedly superimposed to said sprocket wheel, a first spring-loaded hinged pawl releasably engaged to said ratchet wheel whereby backward motion of said ratchet wheel is prevented, a second hinged pawl attached to said lever means for engagement with said toothed notches whereby said ratchet wheel is caused to rotate thereby rotating said sprocket wheel whereby displacement is produced in said sprocket chain interlocked thereto.

* * * * *